US012228370B1

(12) United States Patent
Bernkrant

(10) Patent No.: US 12,228,370 B1
(45) Date of Patent: Feb. 18, 2025

(54) APPARATUS AND METHOD FOR LOADING A CARTRIDGE INTO A CHAMBER OF BREAK-ACTION FIREARM

(71) Applicant: EUROPEAN AMERICAN ARMORY CORP., Cocoa, FL (US)

(72) Inventor: Keith Bernkrant, Cocoa, FL (US)

( * ) Notice: Subject to any disclaimer, the term of this patent is extended or adjusted under 35 U.S.C. 154(b) by 0 days.

(21) Appl. No.: 18/808,998

(22) Filed: Aug. 19, 2024

Related U.S. Application Data

(60) Provisional application No. 63/533,601, filed on Aug. 18, 2023.

(51) Int. Cl.
*F42B 39/00* (2006.01)
*F41A 9/84* (2006.01)
*F41C 9/08* (2006.01)

(52) U.S. Cl.
CPC ..... *F41C 9/085* (2013.01); *F41A 9/84* (2013.01); *F42B 39/002* (2013.01)

(58) Field of Classification Search
CPC ..... F41A 9/82; F41A 9/83; F41A 9/84; F41C 9/085; F42B 39/002
See application file for complete search history.

(56) References Cited

U.S. PATENT DOCUMENTS 863,798 A * 8/1907 Hodges ..... F41A 9/84 42/87
1,874,408 A * 8/1932 Zichy ..... F41A 9/84 42/87
3,991,501 A * 11/1976 Larsson ..... F41A 9/83 42/88
4,869,009 A * 9/1989 Bennett ..... F41A 9/84 42/87
8,997,390 B1 * 4/2015 Heizer ..... F41C 23/22 42/8
9,103,626 B1 * 8/2015 Heizer ..... F41A 3/00
2013/0199070 A1 * 8/2013 Heizer ..... F41A 9/84 42/71.01
2014/0082984 A1 * 3/2014 Kent ..... F41A 9/83 42/88

FOREIGN PATENT DOCUMENTS

EP 2172732 A1 * 4/2010 ..... F41A 9/37
GB 2446158 A * 8/2008 ..... F41A 9/35
GB 2497861 A * 6/2013 ..... F41A 9/35
GB 2586667 A * 3/2021 ..... F41A 9/35
WO WO-8801365 A1 * 2/1988
WO WO-0177603 A1 * 10/2001 ..... F41A 9/84

* cited by examiner

*Primary Examiner* — Gabriel J. Klein
(74) *Attorney, Agent, or Firm* — Lowndes; Stephen C. Thomas; Robert R. Fredeking

(57) ABSTRACT

An apparatus that can be added to a conventional firearm magazine which safely stores an ammunition cartridge for loading into a break action type firearm. The loader is slidably, removably, or fixedly attached to a magazine so that the magazine can be released from the frame of the firearm and used as a grip for loading the round of ammunition into the chamber of a tip-up barrel, or any break action firearm. The loader stores an ammunition cartridge in the correct orientation for quickly loading the cartridge into the chamber of a tip-up pistol barrel, or any break-action firearm barrel.

15 Claims, 8 Drawing Sheets

APPARATUS AND METHOD FOR LOADING A CARTRIDGE INTO A CHAMBER OF BREAK-ACTION FIREARM

CROSS REFERENCE TO RELATED APPLICATIONS AND INCORPORATION BY REFERENCE

This non-provisional patent application claims benefit of priority to U.S. Provisional Application No. 63/533,601, entitled "APPARATUS AND METHOD FOR STORING AND LOADING A ROUND OF AMMUNITION INTO A BREAK ACTION FIREARM", filed in the United States Patent and Trademark Office (USPTO) on Aug. 18, 2023, which is hereby incorporated by reference herein in its entirety.

STATEMENT REGARDING FEDERALLY SPONSORED RESEARCH OR DEVELOPMENT

Not applicable.

FIELD OF THE INVENTION

The field of the invention relates generally to an improved apparatus and method for conveniently storing a round of ammunition (aka a "cartridge") proximate to an unloaded firearm which also provides for quickly accessing and loading the cartridge into a chamber of a firearm barrel, which may be a "tip-up" pistol, or any break-action firearm.

BACKGROUND

When describing firearms, a "chamber" is the cavity at the rear end of the barrel where a cartridge is inserted before being fired. A chamber must be able to contain the cartridge and resulting pressure when it is fired. A pistol is a type of handgun whose chamber is integral with the barrel. A pistol is distinguishable from other types of handguns such as a revolver, which typically has multiple chambers within a rotating cylinder that is separately aligned with a single barrel. Prior to firing, the cartridge is disposed in the chamber. Generally, the outer diameter of a cartridge is received in a chamber in a close fit between the outside diameter of the cartridge and the inside diameter of the chamber, the goal being to transfer as little energy as possible from the burning gunpowder in the cartridge into expanding the cartridge casing. When a cartridge is fired, a portion of the resulting energy is converted into propelling the bullet in a forward direction down the longitudinal axis of the firearm barrel, and a portion of the resulting energy is converted into kinetic energy into the pistol's spring-loaded slide via blowback gases. This energy forces a pistol's slide to cycle backwards towards the shooter into a rearward position. After the energy of the expanding gases from the burning gunpowder is spent, the slide is motivated forward by a recoil spring that was compressed during rearward cycling of the slide. As the slide is motivated forward, a feature of the slide contacts the uppermost cartridge in a magazine that is disposed in an interior volume of the pistol handle, and features of the slide and firearm guide the uppermost magazine cartridge into the chamber, where the process may be repeated. This process is generally termed "semi-automatic" in the industry.

Generally, a cartridge is initially chambered through manipulating the slide of the gun rearward by a hand of a user. This action is also known as "racking the slide".

However, certain individuals may lack the necessary strength required to rack the slide rearwards against the force of the recoil spring.

The recoil spring's purpose is to absorb the shock when a bullet is fired and return the slide forward causing the next cartridge in a firearm's magazine to be chambered. This cyclical rearward and forward movement of the slide operates to eject the casing of the fired round and reloads the next round into the chamber. Typically, when preparing to fire a semi-automatic pistol, a user must manually load the first cartridge to be fired into the firearm's chamber by racking the slide. After firing the first round, each of the following cartridges are automatically loaded into the chamber by the forward movement of the cycling slide.

In the art there is known a certain type of firearm called a "tip-up" pistol. These pistols provide a solution for individuals who don't have enough strength to rack the slide rearwards against the recoil spring. A tip-up pistol allows the rear of the barrel to swing up and away from the firing pin. The barrel pivots around a hinge set into the firearm's frame near the muzzle. This design allows a cartridge to be manually inserted directly into the chamber of the barrel, rather than fed from a magazine via racking the slide. After a round is manually inserted into the chamber, the barrel is closed into firing position and the firearm is ready to shoot. A major benefit of a tip-up barrel is that a shooter is not required to rack the firearm's slide in order to chamber a first cartridge.

If there is a loaded magazine in a semi-automatic tip-up pistol, then the resulting force of the first shot will blow the spent cartridge casing backwards and out of the gun while also cycling the slide rearwards. The recoil spring will then force the slide forwards and feed the next cartridge in the magazine into the firearm's chamber for subsequent shots.

Many individuals choose to store firearms in their home for defensive purposes. Some individuals may also choose to carry a handgun with them throughout the day. Regardless of where an individual keeps their firearm, there are two common ways of storing a firearm should a defensive need ever arise. The first is always having a cartridge "chambered" in the firearm. The second is keeping the chamber of the firearm empty, but with a loaded magazine nearby or already inserted in the firearm.

There are many arguments both for and against keeping a cartridge always chambered in a firearm. Typically, the arguments center around the need to fire a round as quickly as possible in an emergency versus the chances of negligently discharging a round. People who choose to keep the chamber empty argue that the time saved by carrying a round in the chamber isn't significant enough to make a difference since it generally takes less than a second to rack a slide and begin shooting.

However, this argument is moot when talking about individuals who lack the necessary strength to exert the requisite force needed to rack a slide against the force of a firearm's recoil spring. Thus, there are many individuals who choose to own a break-action type of firearm (e.g. a tip-up pistol). Even though manually loading the first round into the chamber of a tip-up pistol is easy, it generally takes much longer than merely racking the slide of a pistol.

In a defensive situation, an individual carrying an unloaded tip-up pistol is subject to locating a first round to be loaded and correctly orientating the round before manually inserting it into the chamber. The potential for fumbling with the round or even dropping the round on the ground are also an ever-present risk. Once the first round is manually inserted into the chamber of a tip-up pistol, the barrel must be pushed downwards into the frame of the gun to be locked before firing.

What is needed in the art, therefore, is an apparatus and method adapted to help an individual securely carry a round of ammunition in the correct orientation which also provides fast and convenient loading capabilities. Thereby allowing a round to be quickly and manually chambered into an unloaded break-action firearm.

BRIEF SUMMARY OF THE INVENTION

The present invention is an apparatus and method that have one or more of the following features and/or steps, which alone or in any combination may comprise patentable subject matter, and which overcome the aforementioned needs of the art.

In an exemplary embodiment, the present invention is an apparatus for loading a cartridge into a chamber of a firearm. The apparatus may be added to the baseplate of a firearm magazine for securely storing and carrying a single round of ammunition. The apparatus improves the time it takes for an individual to load a round of ammunition into a chamber of a break-action firearm.

In embodiments, the apparatus comprises: a housing having a plunger cavity and a cartridge retaining cavity, the cartridge retaining cavity adapted to receive the chamber of a firearm barrel; a plunger at least partially disposed within the plunger cavity; a spring providing a force on a first surface of the plunger; the plunger translatably attached to said housing, the plunger having a plunger second surface adapted to be in contact with a rear surface of a cartridge to be loaded into a chamber of a firearm; the cartridge retaining cavity adapted to removably retain, or removably attach, a cartridge via a slidable engagement; wherein, when said housing is motivated onto the chamber section of a firearm barrel, a cartridge retained in said cartridge retaining cavity is motivated into the chamber; and wherein when said housing is motivated in a direction F orthogonal to a longitudinal axis L of the firearm chamber, a cartridge that is removably attached to said cartridge retaining cavity is removed from the cartridge retaining cavity, leaving the cartridge disposed in the chamber.

In embodiments, the apparatus comprises: a housing having a plunger cavity and a cartridge retaining cavity for storing a cartridge, wherein the plunger cavity comprises a spring and a plunger at least partially disposed in said plunger cavity, wherein the cartridge retaining cavity includes a track adapted to retain a cartridge, the track sized to fit into, and be received by, an extraction groove of a cartridge in a sliding engagement; and wherein the plunger creates a friction retaining force for holding a rim of a cartridge against the track; and wherein the cartridge retaining cavity is large enough to allow a chamber portion of a firearm barrel to fit inside the cartridge retaining cavity, wherein a cartridges stored in the cartridge retaining cavity is inserted into and received by a chamber of a firearm barrel when the chamber is motivated into the cavity.

In embodiments, a plunger and a spring provides a biasing force on the plunger, the biasing force causing a surface of the plunger to press against the rear face of a cartridge that has been loaded into the apparatus with sufficient force to retain the round of ammunition in the cartridge retaining cavity.

In embodiments, the track may be further defined as a U-shaped track sized to be inserted into, and received by, the extraction groove of a cartridge.

In embodiments, the housing may be configured to replace the baseplate of a conventional pistol magazine.

In embodiments, the housing may be configured to be removably attached to an existing baseplate of a pistol magazine.

In embodiments, the housing may be fixedly attached to a firearm magazine.

In embodiments, the firearm may be, but is not necessarily, pistol. Still further, the firearm may be a type of tip-up pistol.

BRIEF DESCRIPTION OF THE DRAWINGS

The accompanying drawings, which are incorporated into and form a part of the specification, illustrate one or more embodiments of the present invention and, together with the description, serve to explain the principles of the invention. The drawings are only for the purpose of illustrating exemplary embodiments of the invention and are not to be construed as limiting the invention. In the drawings.

DETAILED DESCRIPTION

Figure 1:
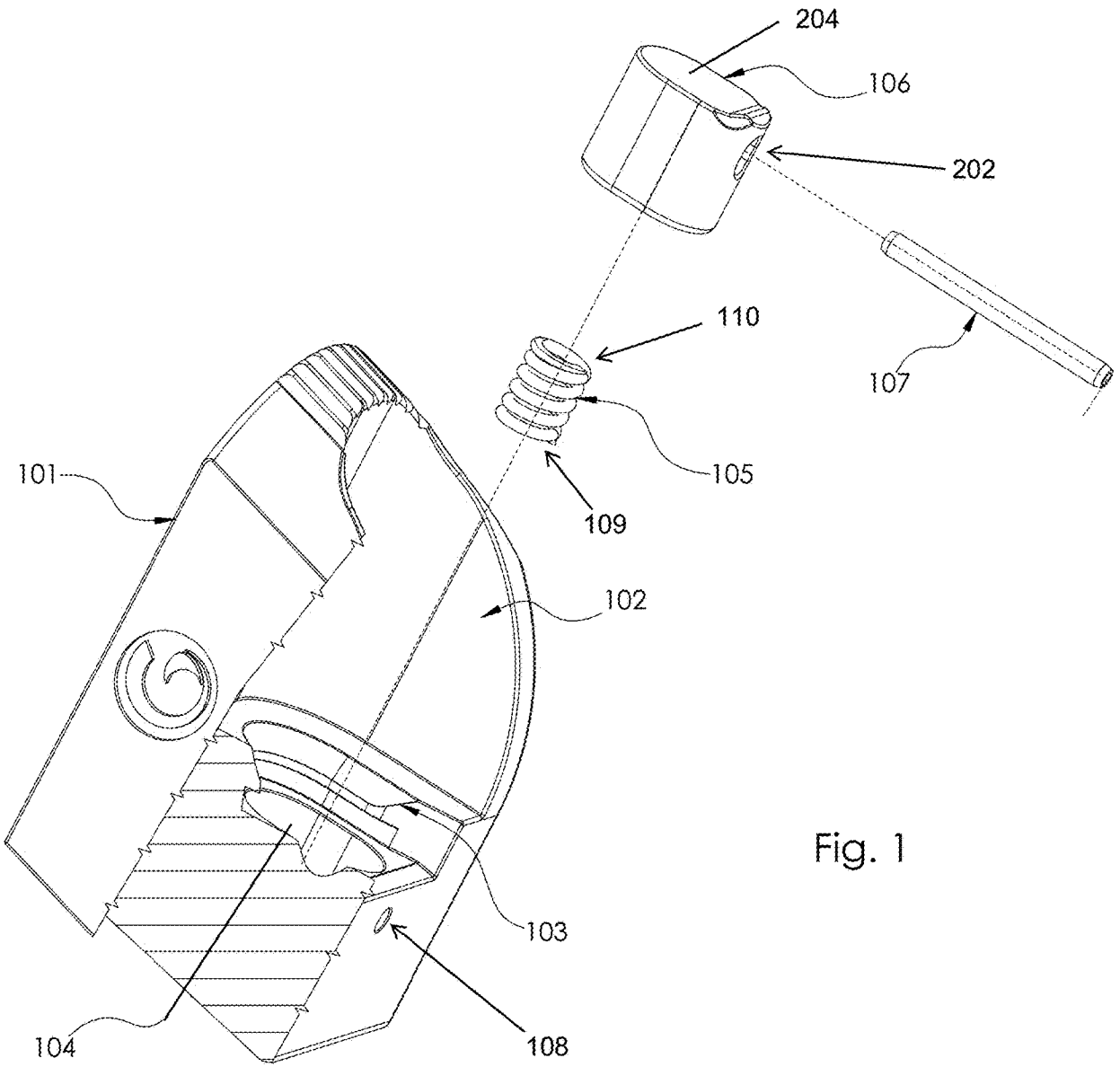
FIG. 1 shows an exploded view of an exemplary embodiment of the invention.

The following documentation provides a detailed description of the invention.

Although a detailed description as provided in this application contains many specifics for the purposes of illustration, anyone of ordinary skill in the art will appreciate that many variations and alterations to the following details are within the scope of the invention. Accordingly, the following preferred embodiments of the invention are set forth without any loss of generality to, and without imposing limitations upon, the claimed invention. Thus, the scope of the invention should be determined by the appended claims and their legal equivalents, and not merely by the preferred examples or embodiments given.

Throughout the specification there are several terms that will be used that are particular to firearms. The terms are to be used in the context of their ordinary and customary meaning as they relate to firearms. Any terms will be specifically defined if meant to depart from their ordinary and customary firearm meaning. For example, a magazine refers to an ammunition storage and feeding device for a repeating firearm. When referring to pistols, magazines are generally considered detachable and are removable from the interior volume of the grip of a pistol. A magazine may be integrated into a firearm or may refer to a detachable type of magazine that may be inserted and removed from the firearm, for example, and not by way of limitation, by insertion of the magazine into a receiving opening in an interior volume of a pistol grip. Removing a magazine from the interior volume of the grip of a pistol is performed by using a magazine release. A magazine release may be a switch, a lever, a button or any other type of release positioned on the frame of a firearm which functions to release a magazine from the interior volume of the grip/frame of a firearm. Pistol magazines generally comprise a shell, a magazine spring, a follower, and a baseplate. Magazine baseplates are a removable bottom piece of the magazine that provides access to a magazine's internal components (magazine spring and follower) for cleaning and maintenance.

A pistol magazine can be loaded and filled with as little or as many rounds as the magazine's capacity allows, usually somewhere between 7 and 20 rounds. But the present invention is not limited to any specific magazine capacity. The number of rounds a magazine may hold depends on the caliber, size of the magazine, and choices of the individual loading the magazine. Still further, contemporary magazines may be a single-stack type or a double-stack type. One of ordinary skill in the art will appreciate that the apparatus of the present invention is configurable to fit any caliber of bullet and any type of magazine.

As used herein, the terms "round", "round of ammunition", "ammunition round", "cartridge", "cartridge of ammunition" and "ammunition cartridge" may be used interchangeably. For purposes of this specification, the terms refer to a single unit of firearm ammunition consisting of a cylindrical case/casing (typically made of a metal or alloy). The case/casing of a cartridge (or round) serves as the integrating housing for the other functional components (i.e. primer, gunpowder, and bullet). Cartridges are sized to fit the interior chamber of a firearm.

As used herein, the term "caliber" is given its ordinary and customary meaning. Certain embodiments described herein may refer to a particular caliber, but the present invention is not limited to any specific caliber. The invention may be configured to be used with any caliber that is presently available or may become available in the future.

For sake of understanding this specification, it is important to note that a cartridge case/casing is not necessarily a perfect cylinder. Rather, this disclosure will talk about the anatomy of a cartridge case using three distinct terms—the rim 401, extraction groove 402, and the body 403.

FIG. 1 illustrates an exploded view of an exemplary embodiment of the present invention. The present invention can be easily added to the bottom of a magazine by replacing the baseplate of a conventional magazine and installing the apparatus in place of a conventional baseplate. In embodiments, the apparatus may merely slide onto an existing magazine baseplate for quick attach/detach capabilities.

The apparatus comprises four main components: a housing 101, a spring 105 having a first end 109 and a second end 110, a plunger 106, and a pin 107. A housing 101 can be made from any metal, polymer, or any other suitable composite or other material, or any combination of the foregoing materials. In embodiments, the housing is constructed as a single piece, which may be done using a mold or 3-D printing. In embodiments, the housing 101 may be manufactured using multiple pieces that are assembled using fasteners, welding, adhesives, or any other means known in the art. The housing 101 can be configured with rails (not shown) on the top portion of the housing which allows for removably attaching the apparatus onto a conventional magazine baseplate without requiring the use of a tool. In embodiments, the housing can be configured to replace the baseplate of a conventional magazine. The process of replacing the baseplate of a conventional magazine is well-known in the art.

The housing 101 has a plunger cavity 104 located in the rear portion of the housing 101 where the spring 105, plunger 106, and pin 107 are all disposed when fully assembled and function together to create a spring-loaded friction retaining force for a cartridge. The plunger 106 may be attached to the housing 101 by insertion of the pin 107 into a pin hole 108 and through a plunger void 202, pin 107 being received by an opening 600 in housing 101, which opening may be a blind opening, thereby creating a translatable attachment.

Still referring to FIG. 1, the housing 101 comprises a cartridge retaining cavity 102 where a cartridge may be securely carried/stored. The cartridge retaining cavity 102 of the housing 101 may be, for example and not by way of limitation, semi-circular in nature and large enough to allow the chamber of a firearm's barrel to slide into and be received by the cartridge retaining cavity 102 when loading a cartridge 400 stored/carried in the apparatus into a chamber of a barrel. One of ordinary skill in the art will appreciate that the shape of the cartridge retaining cavity 102 is not limited, rather the critical feature being that the cartridge retaining cavity 102 be larger than the outside diameter of a particular firearm's barrel 502 so that the firearm barrel may be received by the cartridge retaining cavity.

The cartridge retaining cavity 102 of the housing 101 further comprises an integral "U-shaped" track 103, hereinafter referred to as the "track". The track 103 functions to receive an extraction groove 402 of a cartridge in a slidable engagement and properly align a cartridge in the cartridge retaining cavity 102 for loading a cartridge into a chamber of a firearm barrel. A feature of the track 103 is the forward tapering that occurs at the bottom of the track. This tapering functions cooperatively with the plunger 106 so that the cartridge is "kicked" forward when released from the track 103 when the housing 101 is motivated in the direction F, orthogonal to the longitudinal axis L of the chamber. This kick forward helps to push the cartridge into a chamber of a barrel when loading the cartridge into a firearm.

Figure 2:
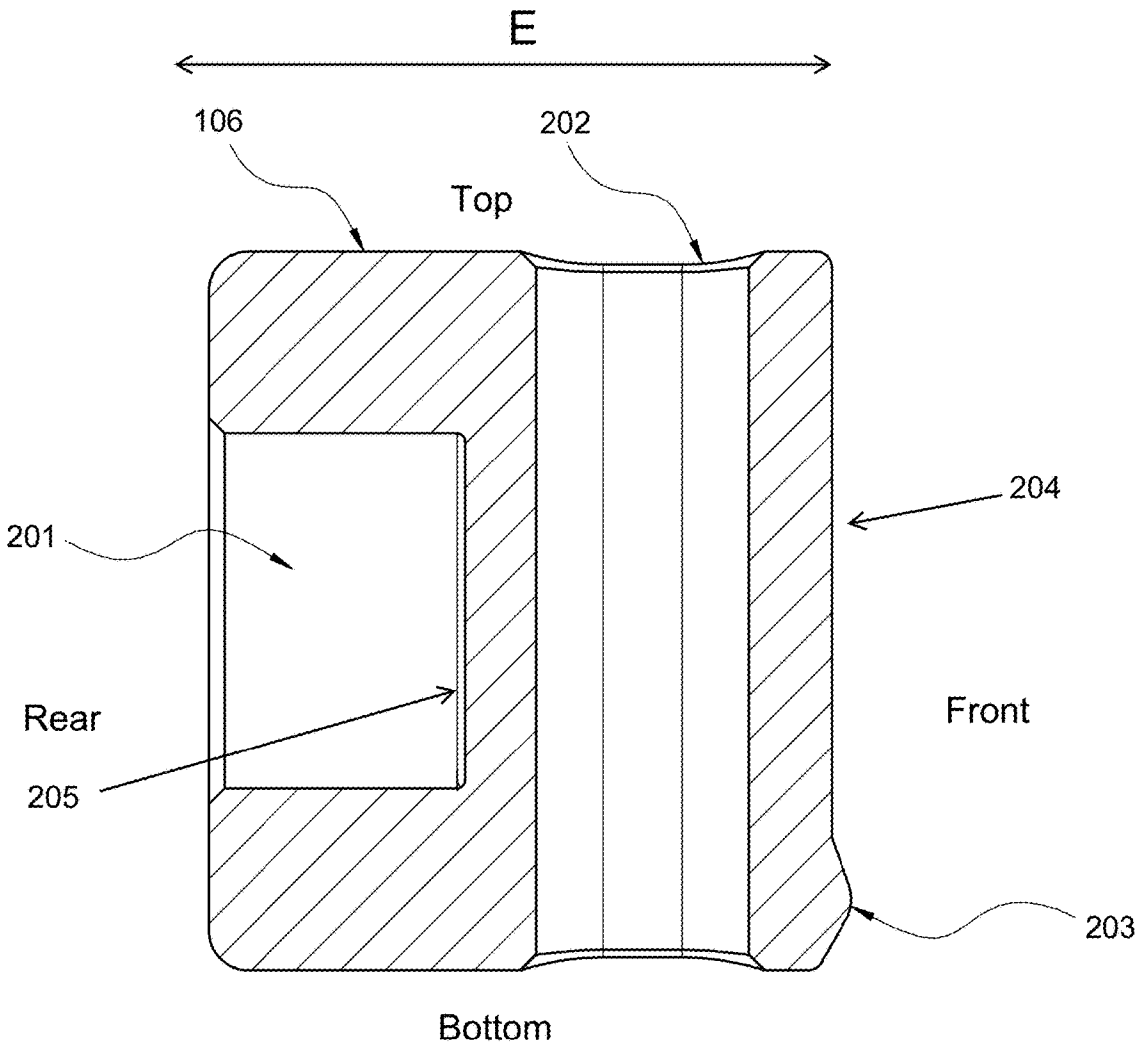
FIG. 2 shows a cross-sectional view of a plunger 106 as shown in FIG. 1.

Referring to FIG. 2, a cross-section of an exemplary embodiment of a plunger 106 is shown. As can be seen, the plunger 106 comprises a rear cavity 201 having a cavity front surface 205, a void 202, a front face 204, and a "lip" 203 located near the bottom portion of the plunger's front face 204. The plunger's rear cavity 201 receives a spring 105 for providing a forward biasing force of the plunger during use of the invention. In an exemplary embodiment, the plunger's void 202 runs vertically through the plunger 106 for receiving a pin 107 to create a translatable attachment in the plunger cavity 104 of the housing 101. The translatable attachment allows the plunger to translate back and forth in direction E during the loading and unloading of a cartridge in the apparatus. In embodiments, the void may run horizontally through the plunger 106 for creating a translatable attachment.

The design of the plunger lip 203 also facilitates the functioning of the apparatus. This lip 203 functions both to help securely hold a cartridge in place during storage of a cartridge in the apparatus and to assist with the forward kick of the cartridge into the chamber of a barrel as the cartridge is released from the apparatus.

Figure 3:
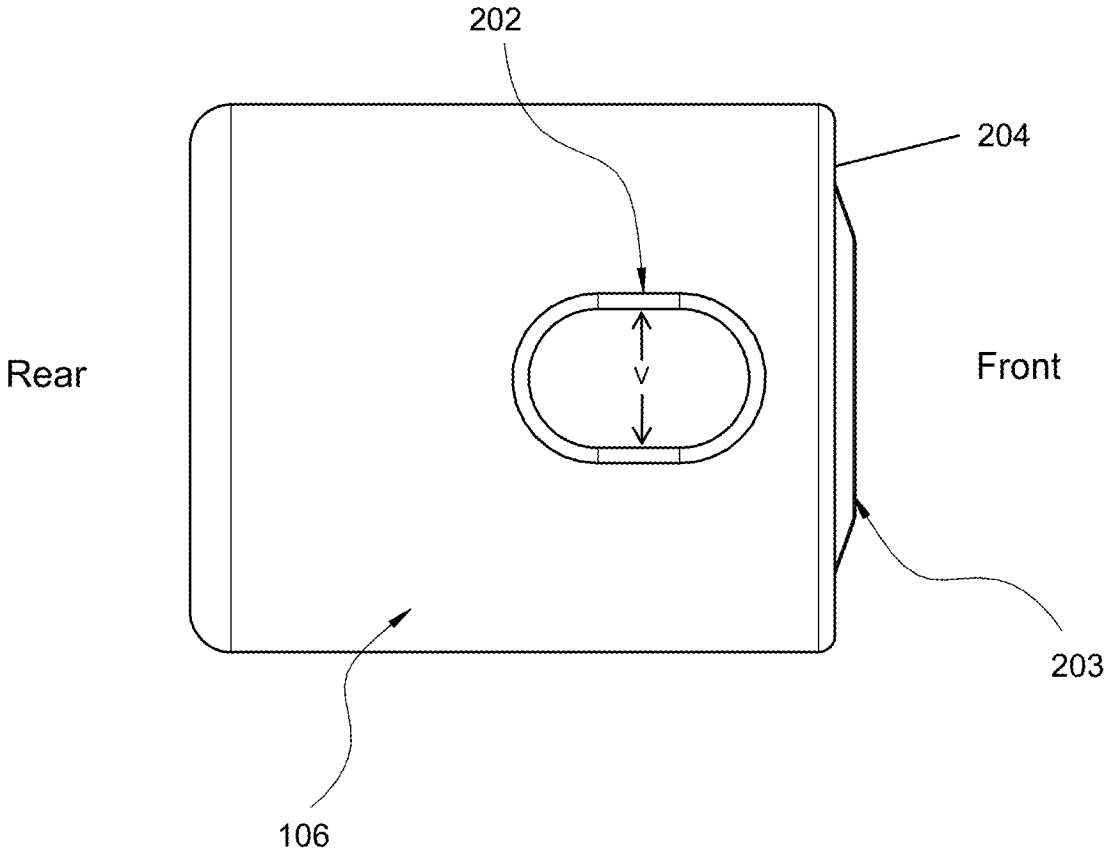
FIG. 3 shows a top-down perspective view of a plunger 106 as shown in FIG. 1.

Now referring to FIG. 3, shown is a top view of an exemplary embodiment of a plunger 106. The void 202 running vertically through the plunger 106 has a width V larger than the diameter of the pin 107 to allow the plunger 106 to be translatable in direction E relative to the housing 101 and pin 107 when the apparatus is fully assembled.

Figure 4:
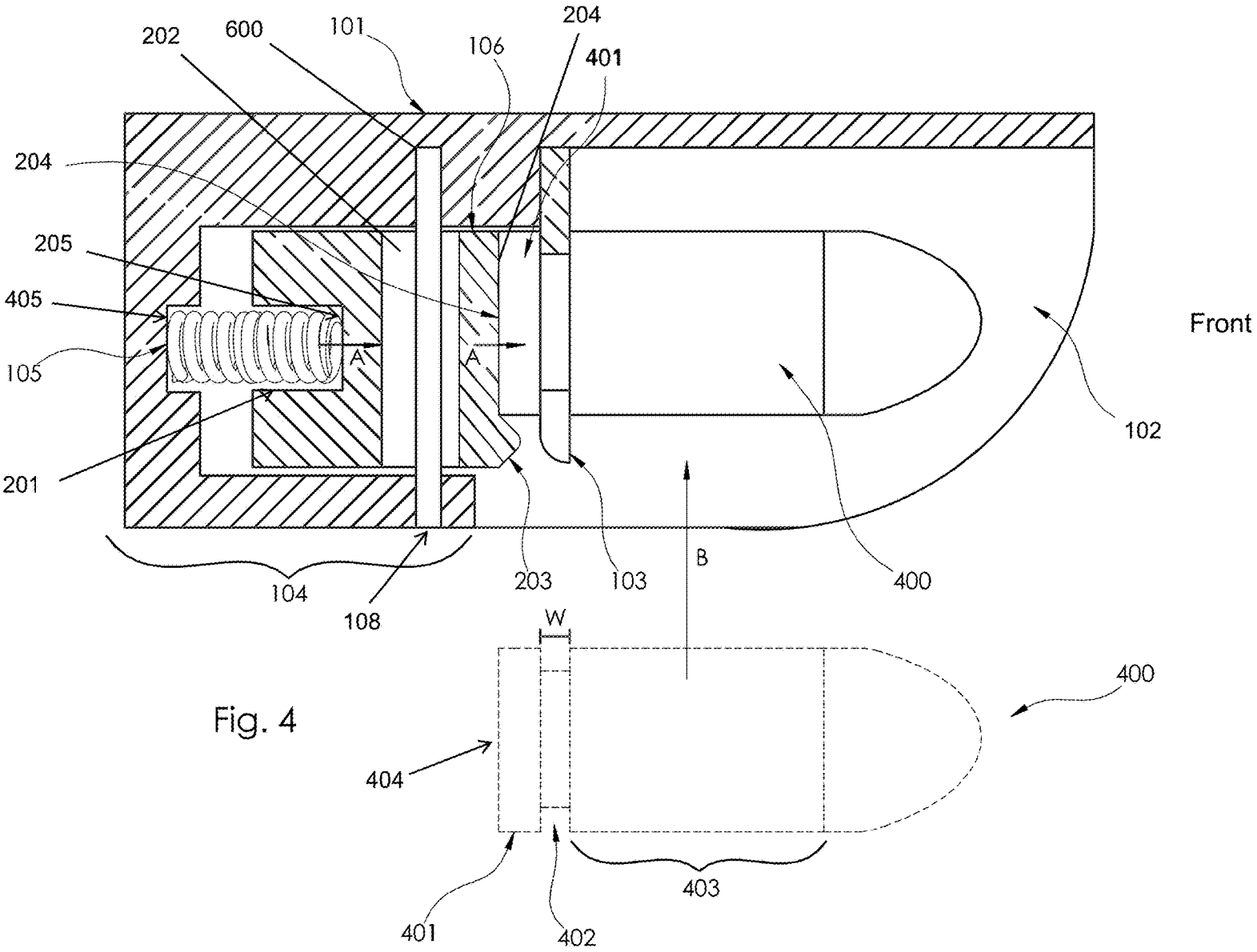
FIG. 4 shows a cross-sectional view of an exemplary embodiment and illustrates the process of loading a cartridge for storage into the apparatus.

Referring to FIG. 4, an illustration is shown of a cartridge 400 being motivated in direction B into the cartridge retaining cavity 102 of an apparatus during the process of loading a cartridge 400 into the apparatus. A cartridge 400 comprises a casing having a rim 401, an extraction groove 402 having a width W, and a body 403. The track 103 is configured in size to slidably ride in the extraction groove 402 of a cartridge's casing. In other words, track 103 is configured in size to have a width according to the specific caliber of a cartridge. The width of the track 103 may be determined according to size W of a caliber's particular extraction groove 402 (the gap distance W between a cartridge's rim 401 and case body 403). This allows the extraction groove 402 to serve as a channel for slidably receiving the track 103 of the housing 101 when a cartridge 400 is loaded into the cartridge retaining cavity 102 of the apparatus by motivating the cartridge in direction B.

Still referring to FIG. 4, upon motivation of a cartridge 400 in direction B, a cartridge's rim 401 contacts the lip 203 of a plunger 106 thereby depressing the plunger 106 rearwards into the plunger cavity 104 compressing spring 105 against a plunger cavity spring contact surface 405. The rearward depression of the plunger 106 compresses spring 105, resulting in a forward biasing force A on plunger 106 that is translated to a cartridge's rear face 404. The spring 105 provides the necessary force in a forward direction to create a friction retaining force between the cartridge rim 401 and track 103. That is to say, the rim 401 of the casing 400 is effectively pinned between the forward face of the plunger 204 and the rear face of the track 103.

With respect to an exemplary embodiment of the present invention, operation is relatively straightforward. Referring to FIG. 4, a cartridge 400 may be loaded into the apparatus by motivating the round in direction B into the cartridge retaining cavity 102 so that the cartridge's extraction groove 402 is received by the track 103. As the round is further motivated in direction B, the rear face of the rim 401 contacts the front face 204 of the plunger 106, thereby pushing the plunger 106 (and spring 105) rearwards into the plunger cavity 104 of the housing 101. The compressed spring thereby provides a biasing force on the plunger 106 in direction A, which is then translated by the plunger 106 to the rear face of the cartridge's rim 401, effectively pinning the rim 401 of the round between the plunger 106 and the track 103. Cartridge 400 is held in place against the force of gravity by operation of biasing force A provided by the compressed spring 105 acting on the rear surface 404 of the cartridge's rim 401.

Figure 5:
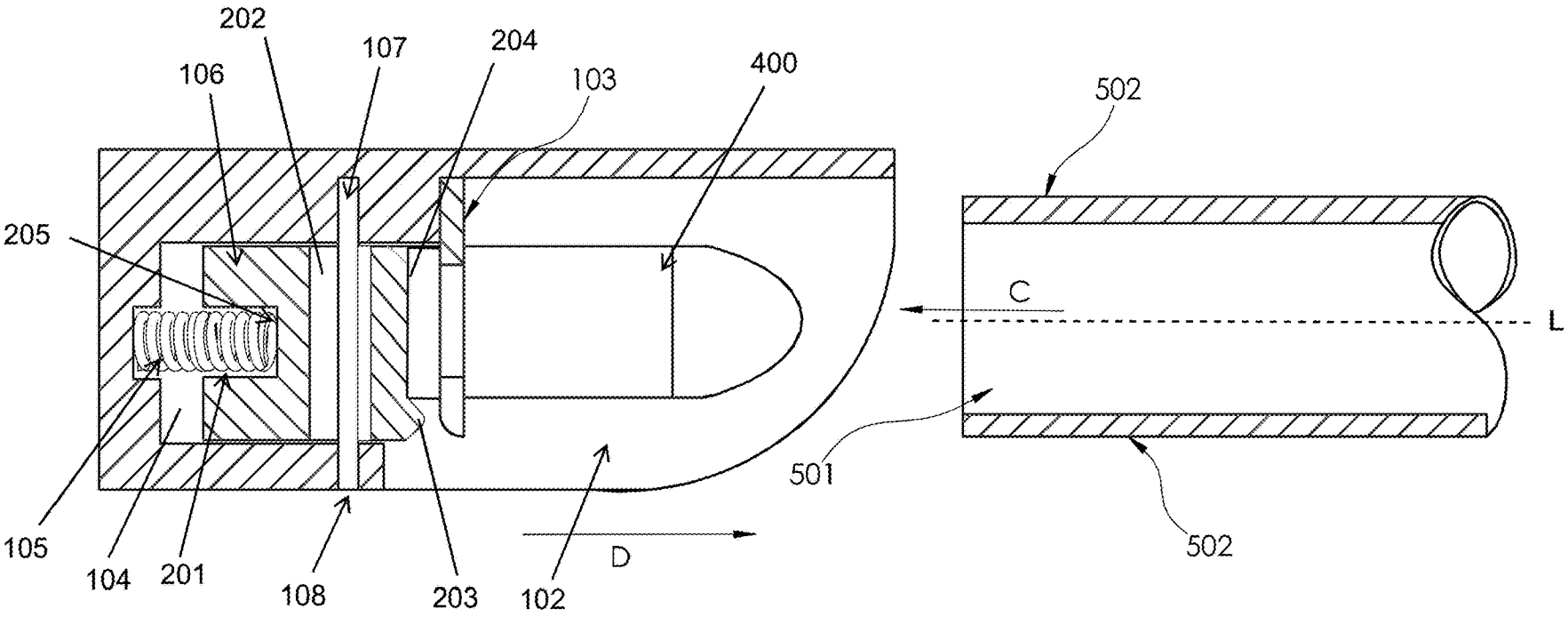
FIG. 5 shows a cross-sectional view of an exemplary embodiment of the present invention and illustrates the alignment of the apparatus with a chamber of a firearm barrel.
Figure 8:
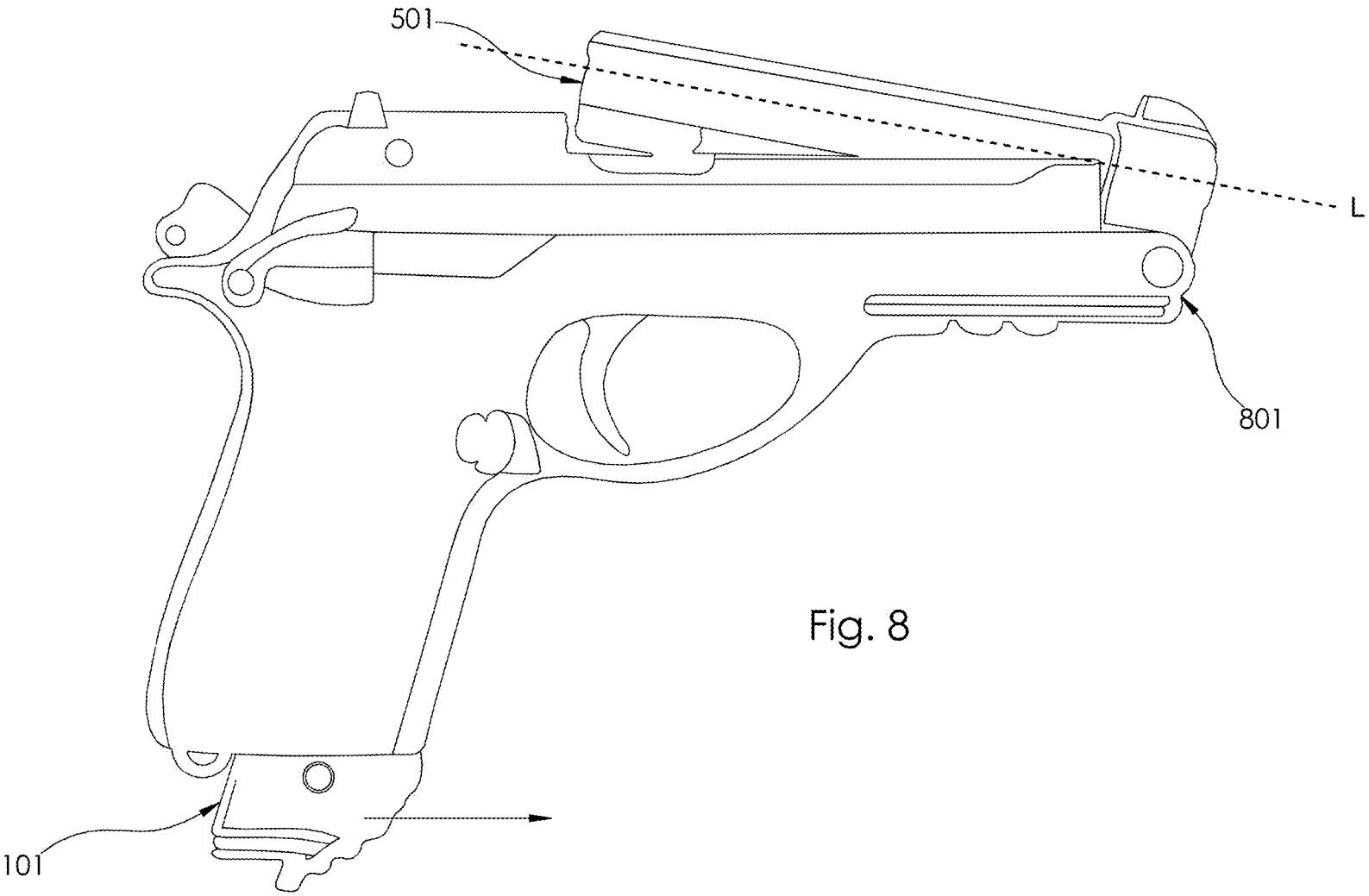
FIG. 8 shows an exemplary embodiment of how the apparatus can be slidably detached from a firearm.

Referring to FIGS. 5 & 8, when a shooter desires to shoot a firearm having a tip-up barrel, the tip-up barrel is unlocked and swung up (or "tipped up") at hinge 801 and away from the firing pin. The shooter can then eject the firearm's magazine (not shown) and attached apparatus 101 and bring a cartridge 400 into alignment with longitudinal axis L of a firearm's barrel while the round 400 is captured within the cartridge retaining cavity 102. The barrel is then brought into, and received by, the cartridge retaining cavity 102 of the housing by motivating the barrel in the direction indicated by arrow C, thereby loading cartridge 400 into the firearm's chamber 501. Alternatively, the housing 101 could be brought forward in the direction of arrow D towards the barrel 502 so that the chamber 501 of the barrel 502 receives the cartridge 400 stored in the cartridge retaining cavity 102.

Figure 6:
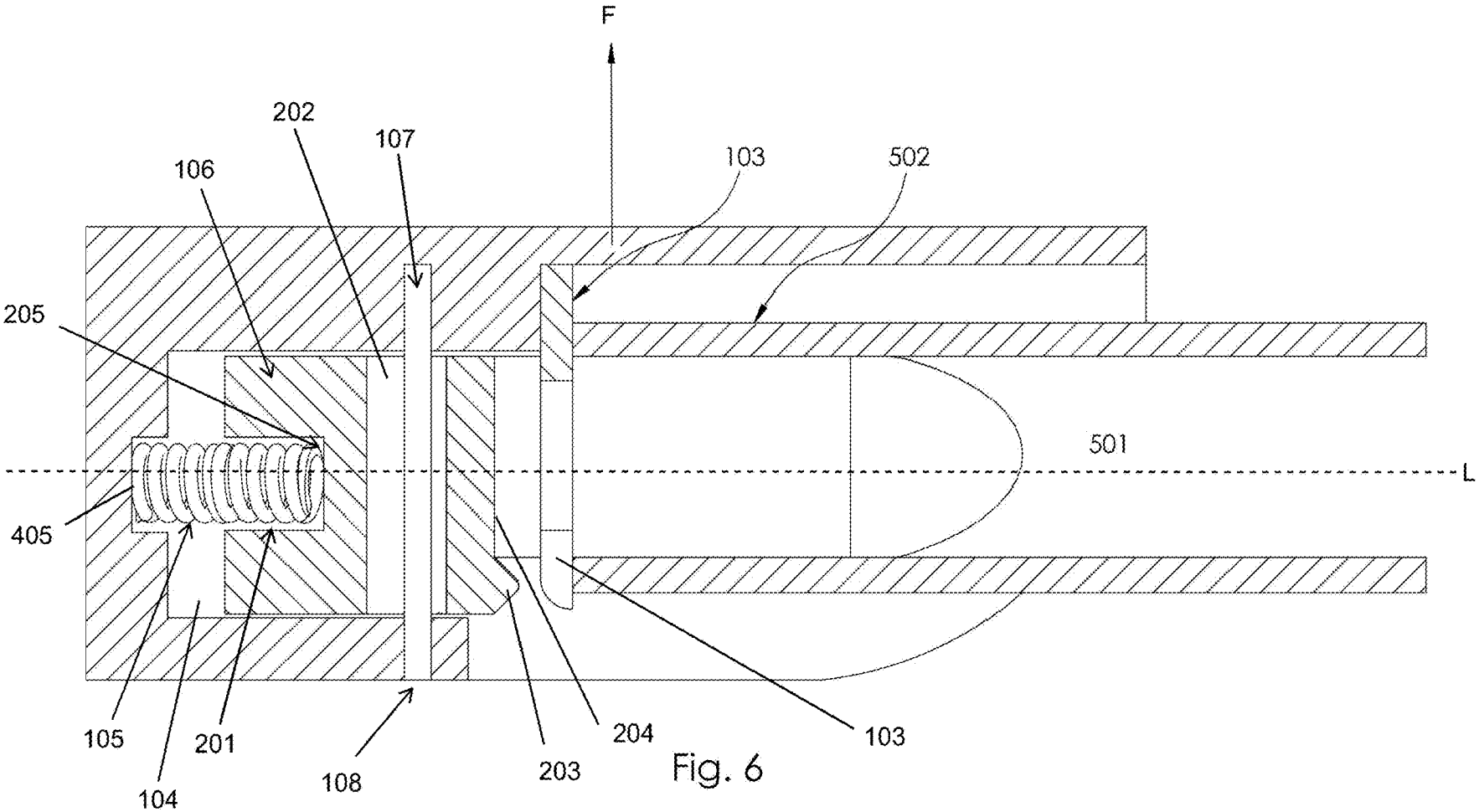
FIG. 6 shows a cross-sectional view of a cartridge loaded into a chamber and illustrates how the cartridge is released from the apparatus.

Referring to FIG. 6, in embodiments, the magazine (not shown) may provide a grip and leverage for the shooter to motivate the apparatus in direction F with sufficient force to overcome the friction retaining force A provided by the plunger 106 after the cartridge 400 has been received by a chamber 501.

Figure 7:
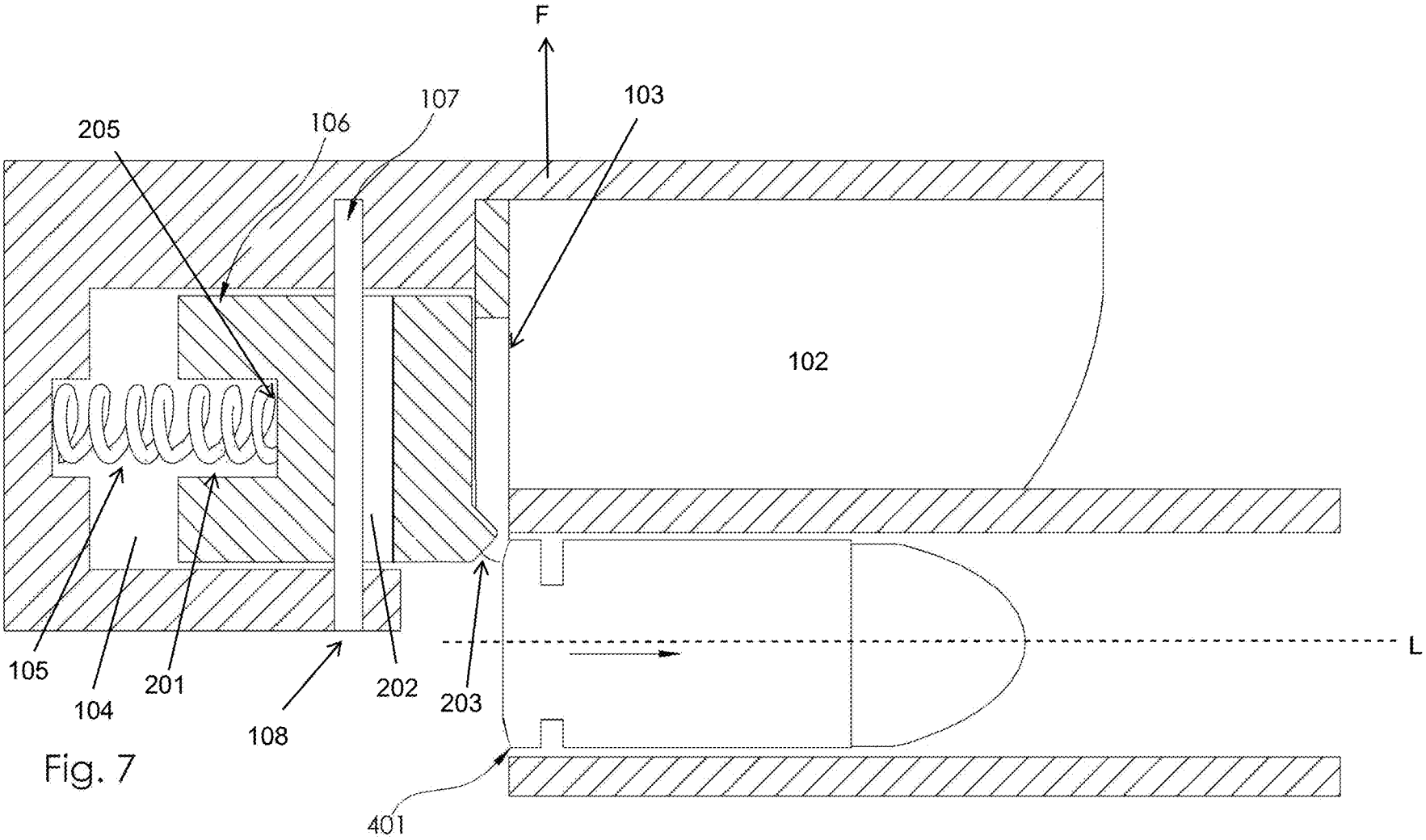
FIG. 7 shows a cross-sectional view of a cartridge being motivated into a chamber as the cartridge is slidably disengaged from a track of the apparatus.

Referring to FIGS. 6 & 7, upon motivating the apparatus in direction F, the cartridge 400 disengages from the track 103 of the apparatus and is kicked forward along longitudinal axis L into the chamber 501 by the lip 203 of the plunger 106, thereby leaving the cartridge 400 loaded in the chamber 501 of the barrel 502. In the case in which barrel 502 is a tip-up barrel, the barrel may then be rotated down to a locked position, which leaves the primer of the cartridge 400 in line with the firing pin. The firearm is now ready to fire with a double-action pull of the trigger or the hammer can be cocked backwards for a single-action pull of the trigger. If the loaded magazine is inserted back into the grip, then the firearm will now function as a semi-automatic without ever requiring the shooter to manually rack the slide rearwards, which, as mentioned above, may be difficult or even impossible for some shooters to accomplish.

The apparatus may be separate or may be affixed the baseplate of a gun magazine. In some embodiments, the apparatus is attached to the magazine and the magazine (and attached apparatus) can be stored in the grip of a firearm. In other embodiments, the magazine (and attached apparatus) can be stored apart from the firearm. Still further, in embodiments envision the apparatus may be separate from the magazine. In any of the foregoing embodiments, the present invention provides an apparatus and method for quickly and easily storing a single cartridge, retrieving the cartridge, and for loading said cartridge into a chamber of a firearm's barrel.

While the exemplary embodiments described herein and shown in the figures are directed to an apparatus for storing a cartridge of ammunition and for loading the cartridge into a chamber of a firearm barrel, the intended scope of the invention includes in conjunction with any firearm having a chamber that is accessible from the rear. This includes but is not limited to pistols having tip-up barrels and rifles having barrels that swivel up to allow loading from the rear, such as, but not limited to, single-shot break-away or break action rifles and the like.

What is claimed is:

1. An apparatus for loading a cartridge into a chamber of a firearm barrel, comprising:

a housing having a plunger cavity and a cartridge retaining cavity, the cartridge retaining cavity adapted to receive the chamber of a firearm barrel;

a plunger at least partially disposed within the plunger cavity;

a spring providing a force on a cavity front surface of the plunger;

the plunger translatably attached to said housing, the plunger having a plunger front face adapted to be in contact with a rear surface of a cartridge to be loaded into a chamber of a firearm;

the cartridge retaining cavity adapted to removably retain a cartridge via a slidable engagement;

wherein, when said housing is motivated onto the chamber of a firearm barrel, a cartridge retained in said cartridge retaining cavity is motivated into the chamber; and wherein when said housing is motivated in a direction orthogonal to a longitudinal axis of the chamber, a cartridge that is removably attached to said cartridge retaining cavity is removed from the cartridge retaining cavity, leaving the cartridge disposed in the chamber.

2. The apparatus of claim 1, wherein said plunger is located within a plunger cavity, and where said spring is disposed in said plunger cavity.

3. The apparatus of claim 1, wherein said plunger cavity comprises a spring contact surface, and wherein said spring has a first end and a second end, said spring first end in contact with said plunger cavity spring contact surface, and said spring second end in contact with said cavity front surface.

4. The apparatus of claim 1, wherein said plunger is translatably attached within the housing via a pin, said pin having a first end and a second end, the first end and second end each fixedly attached to said housing, and wherein said pin is disposed in a slot passing through the plunger, allowing the plunger to be translated in a lateral direction.

5. The apparatus of claim 4, wherein said plunger front face further comprises a lip at protruding from a lower portion of the front face for motivating the cartridge further into the chamber when said housing is motivated in a direction orthogonal to an axis of the chamber.

6. The apparatus of claim 5, wherein said slot of the plunger is further defined as having a width greater than a diameter of said pin for allowing the plunger to translate within the plunger cavity.

7. The apparatus of claim 6, wherein said housing further comprises a track having a track front face and a track rear face for removably attaching a cartridge to said track.

8. The apparatus of claim 7, wherein said track has a width that is sized to fit into, and be received by, an extraction groove of the round of ammunition in a sliding engagement to retain the cartridge.

9. The apparatus of claim 8, wherein the force provided by said spring, said plunger, and said track function cooperatively to create a friction retaining force for retaining a rim of the cartridge between the front face of the plunger and the track rear face.

10. The apparatus of claim 9, wherein the cartridge retaining cavity is large enough to receive a chamber of a firearm barrel, such that a round of ammunition removably retained in the cartridge retaining cavity is inserted into and received by an interior of the chamber when the chamber is motivated into the cartridge retaining cavity.

11. The apparatus of claim 7, wherein said track is further defined as U-shaped track.

12. The apparatus of claim 1, wherein the firearm is further defined as a tip-up barrel pistol.

13. The apparatus of claim 1, wherein the housing is configured to replace the baseplate of a firearm magazine.

14. The apparatus of claim 1, wherein the housing is adapted to be removably attached to a firearm grip.

15. The apparatus of claim 1, wherein the housing is adapted to be removably attached to a firearm magazine.

* * * * *